US005967310A

United States Patent [19]

Hill

[11] Patent Number: 5,967,310

[45] Date of Patent: Oct. 19, 1999

[54] CONTAINER SYSTEM FOR SMOKING COMPONENTS

[76] Inventor: Chrisjon Hill, 1324 Central Ave., Sarasota, Fla. 34236

[21] Appl. No.: 09/073,565

[22] Filed: May 6, 1998

[51] Int. Cl.[6] ..... A24F 15/00

[52] U.S. Cl. ..... 206/242; 206/252; 131/329

[58] Field of Search ..... 206/242, 249, 206/250, 252, 253, 265; 131/329, 260

[56] References Cited

U.S. PATENT DOCUMENTS

| | | | |
|---|---|---|---|
| Re. 31,076 | 11/1982 | Herman | 206/246 |
| 4,214,658 | 7/1980 | Crow | 206/244 |
| 4,223,687 | 9/1980 | Sandeen | 131/180 |
| 5,465,738 | 11/1995 | Rowland | 131/329 |
| 5,605,226 | 2/1997 | Hernlein | 206/86 |
| 5,810,164 | 9/1998 | Rennecamp | 206/256 |
| 5,832,935 | 11/1998 | Heine | 131/329 |

*Primary Examiner*—David T. Fidel

[57] ABSTRACT

A container system for smoking components including a main body portion which has a front face, a rear face and side faces with a closed lower face and an open upper face. A first recess extends downwardly from the upper face toward the bottom face. A second recess extends downwardly from the upper face and a small aperture extends downwardly from the upper face intermediate the first recess and second recess and closer to the rear face than to the front face. A cover plate is provided having a configuration essentially equivalent in size and shape to the upper face, with a hole therethrough overlying the aperture. A fastener extends through the hole of the cover plate into the aperture of the upper face to allow for the pivotal coupling of the cover plate to the upper face. The cover plate is adapted to be rotated between any of four positions.

7 Claims, 3 Drawing Sheets

CONTAINER SYSTEM FOR SMOKING COMPONENTS

BACKGROUND OF THE INVENTION

1. Field of the Invention

The present invention relates to a container system for smoking components and more particularly pertains to conveniently storing and dispensing smoking components from a container system.

2. Description of the Prior Art

The use of containers for various components of known designs and configurations is known in the prior art. More specifically, containers for various components of known designs and configurations heretofore devised and utilized for the purpose of storing and dispensing contents from a container through known methods and apparatuses are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 5,465,738 to Rowland discloses a Smoking System.

U.S. Pat. No. 4,214,658 to Crow discloses a Smoking System.

In this respect, the container system for smoking components according to the present invention substantially departs from the conventional concepts and designs of the prior art, and in so doing provides an apparatus primarily developed for the purpose of conveniently storing and dispensing smoking components from a container system.

Therefore, it can be appreciated that there exists a continuing need for a new and improved container system for smoking components which can be used for conveniently storing and dispensing smoking components from a container system. In this regard, the present invention substantially fulfills this need.

SUMMARY OF THE INVENTION

In view of the foregoing disadvantages inherent in the known types of containers for various components of known designs and configurations now present in the prior art, the present invention provides an improved container system for smoking components. As such, the general purpose of the present invention, which will be described subsequently in greater detail, is to provide a new and improved container system for smoking components which has all the advantages of the prior art and none of the disadvantages.

To attain this, the present invention essentially comprises a container system for smoking components and for the convenient storing and dispensing of such components. The system comprises a main body portion and has a front face in a generally rectangular configuration. The system also comprises a rear face in a generally rectangular configuration and side faces in a generally semi-circular configuration with a closed lower generally oval lower face and an open generally oval upper face. The main body portion is fabricated of a rigid metal or wood or a rigid plastic material. Also provided is a small circular first recess which extends downwardly from the upper face toward the bottom face to a first distance for supporting a smoking tube with or without filters. A large generally oval second recess extends downwardly from the upper face to a second distance less than the first distance for supporting a smoking substance. A third generally rectangular recess is formed in the front face with short side walls and a short bottom wall for receiving smoking paper. A small threaded aperture extends downwardly from the upper face intermediate the first recess and closer to the rear face than to the front face. Also provided is a generally oval cover plate fabricated of a rigid metal or wood or a rigid plastic material. The cover plate has a generally oval configuration essentially equivalent in size and shape to the upper face with a hole therethrough overlying the aperture. A threaded screw extends through the hole of the cover plate into the aperture of the upper face to allow for the pivotal coupling of the cover plate to the upper face. The cover plate is adapted to be rotated 360 degrees between any of four positions. A first position totally overlies the upper surface and closes all three recesses therein. A second position ninety degrees from the closed position opens the first recess but partially closes the second and third recesses. A third position one hundred eighty degrees from the closed position with its axis parallel to the axis of the upper face opens the third recess but partially closes the first and second recesses. Lastly, a fourth position two hundred seventy degrees from the closed position opens the second recess but partially closes the first and third recesses. A stack of paper sheets is located within the third recess. A quantity of tobacco is in the second recess. A rigid tube is positioned within the first recess adapted to be removed by a user and inserted into the second opening for the forcing of smoking products to the interior thereof. A coil spring is preferably located in the first recess to assist in the removal of the tube. Filters may also be located in the first recess.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved container system for smoking components which has all the advantages of the prior art containers for various components of known designs and configurations and none of the disadvantages.

It is another object of the present invention to provide a new and improved container system for smoking components which may be easily and efficiently manufactured and marketed.

It is a further object of the present invention to provide a new and improved container system for smoking components which is of a durable and reliable construction.

An even further object of the present invention is to provide a new and improved container system for smoking components which is susceptible of a low cost of manufacture with regard to both materials and labor, and which accordingly is then susceptible of low prices of sale to the consuming public, thereby making such container system for smoking components economically available to the buying public.

Still yet another object of the present invention is to provide a new and improved container system for smoking components which provides in the apparatuses and methods of the prior art some of the advantages thereof, while simultaneously overcoming some of the disadvantages normally associated therewith.

Still another object of the present invention is to conveniently store and dispense smoking components from a container system.

Lastly, it is an object of the present invention to provide a new and improved container system for smoking components including a main body portion which has a front face, a rear face and side faces with a closed lower face and an open upper face. A first recess extends downwardly from the upper face toward the bottom face. A second recess extends downwardly from the upper face and a small aperture extends downwardly from the upper face intermediate the first recess and second recess and closer to the rear face than to the front face. A cover plate is provided having a configuration essentially equivalent in size and shape to the upper face, with a hole therethrough overlying the aperture. A fastener extends through the hole of the cover plate into the aperture of the upper face to allow for the pivotal coupling of the cover plate to the upper face. The cover plate is adapted to be rotated between any of four positions.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
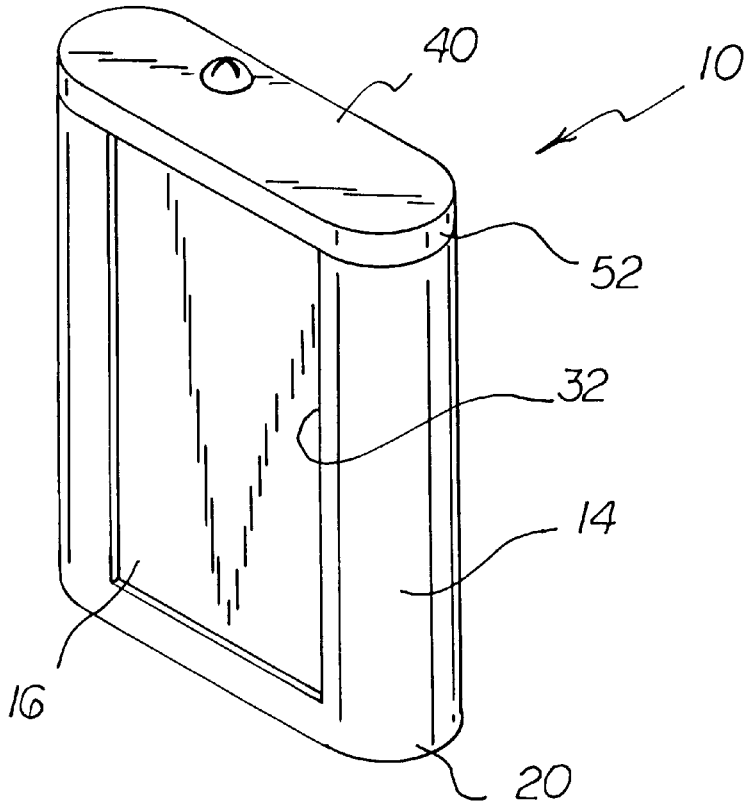
FIG. 1 is a perspective illustration of the preferred embodiment of the container system for smoking components constructed in accordance with the principles of the present invention.
Figure 2:
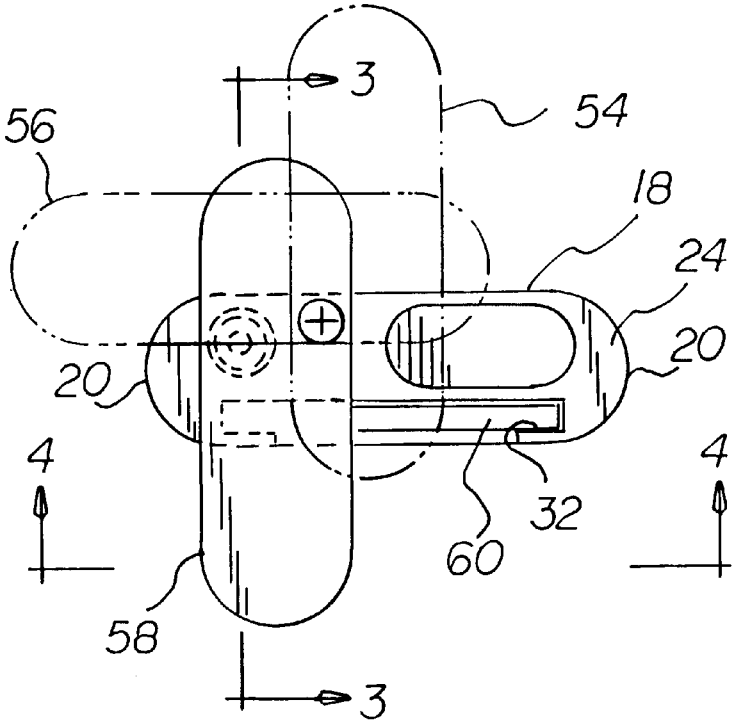
FIG. 2 is a top elevational view of the system shown in FIG. 1 showing the four orientations of the cover.
Figure 3:
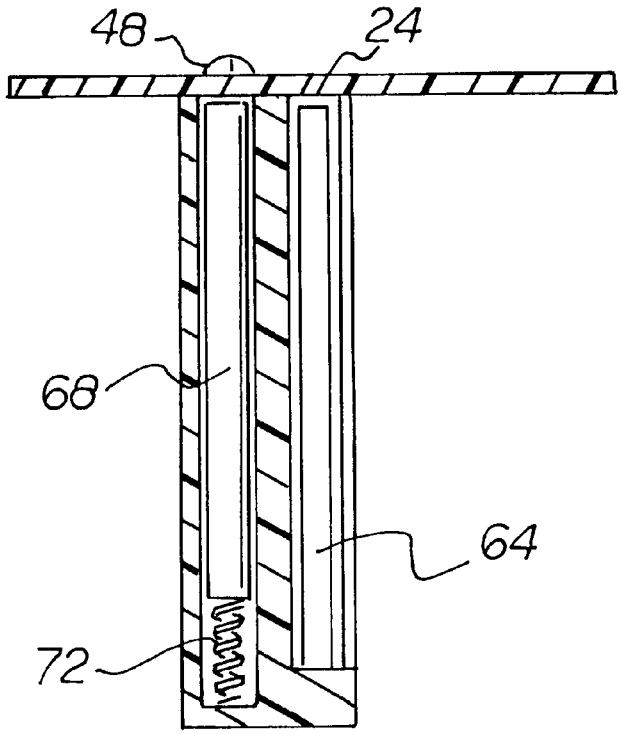
FIG. 3 is a cross-sectional view taken along line 3—3 of FIG. 2.
Figure 4:
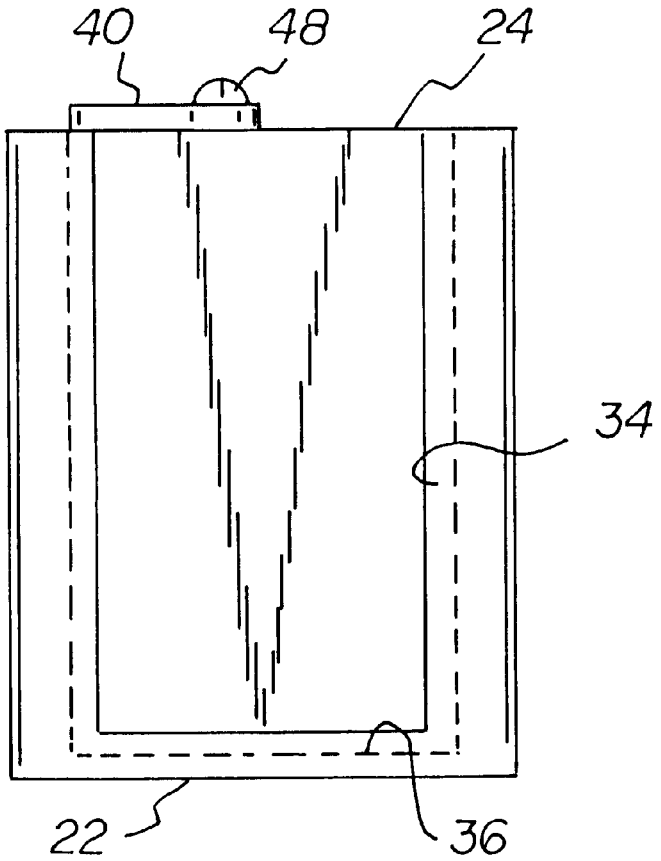
FIG. 4 is a front elevational view taken along line 4—4 of FIG. 2.
Figure 5:
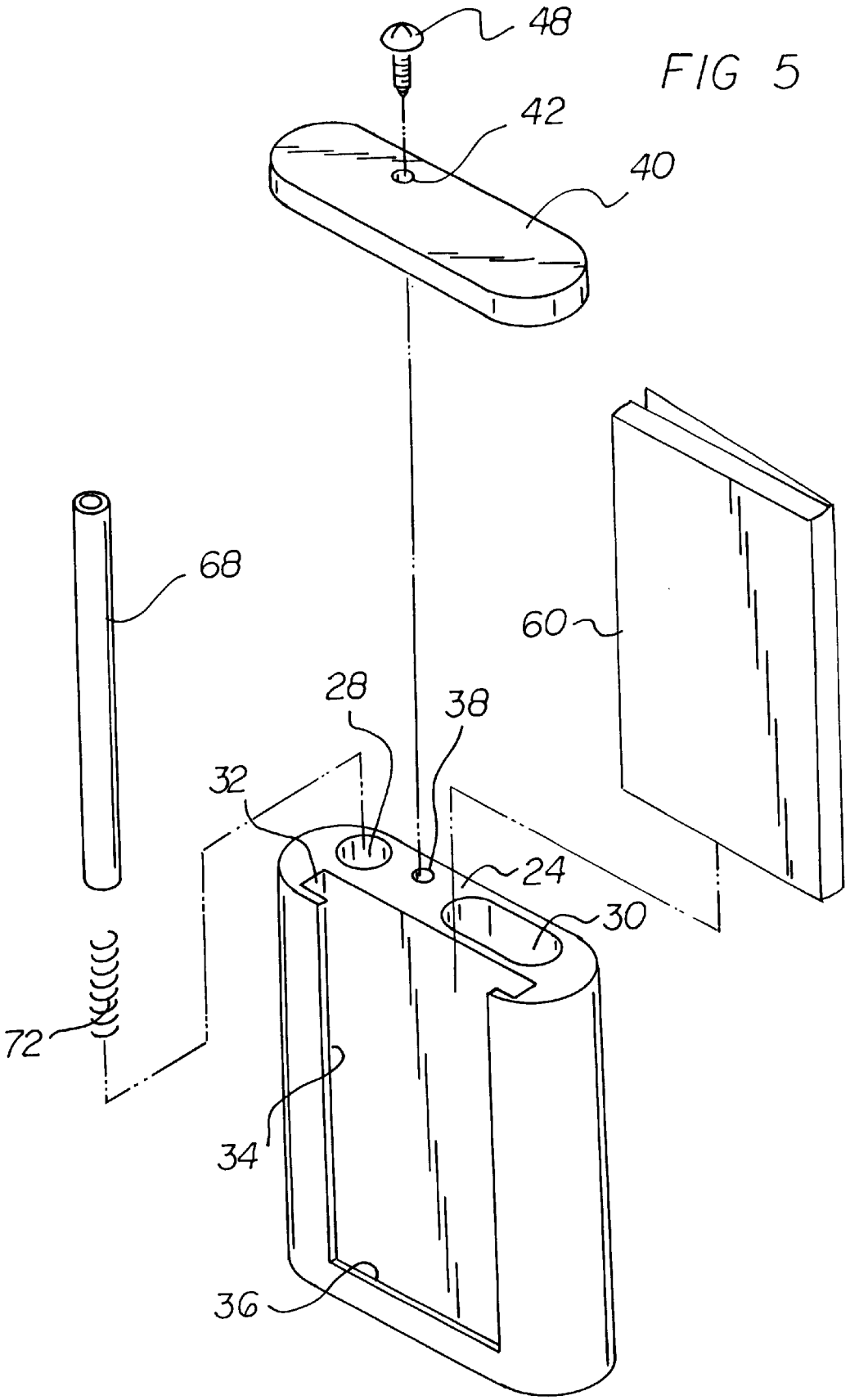
FIG. 5 is an exploded perspective view of the system shown in the prior Figures.

With reference now to the drawings, and in particular to FIG. 1 thereof, a new and improved container system for smoking components embodying the principles and concepts of the present invention and generally designated by the reference numeral 10 will be described.

The present invention, the new and improved container system for smoking components, is comprised of a plurality of components. Such components in their broadest context include a main body portion, a front face and a rear face. Such components are individually configured and correlated with respect to each other so as to attain the desired objective.

More specifically, it will be noted that the container system 10 for smoking components and for the convenient storing and dispensing such components comprises, in combination: a main body portion 14 having a front face 16 in a generally rectangular configuration. The system also comprises a rear face 18 in a generally rectangular configuration and side faces 20 in a generally semi-circular configuration with a closed lower generally oval lower face 22 and an open generally oval upper face 24. The main body portion is fabricated of a rigid plastic material.

Also provided is a small circular first recess 28 which extends downwardly from the upper face toward the bottom face to a first distance for supporting a smoking tube and/or filters. A large generally oval second recess 30 extends downwardly from the upper face to a second distance less than the first distance for supporting a smoking substance. A third generally rectangular recess 32 is formed in the front face with short side walls 34 and a short bottom wall 36 for receiving smoking paper. A small threaded aperture 38 extends downwardly from the upper face intermediate the first recess and closer to the rear face than to the front face.

Also provided is a generally oval cover plate 40 is fabricated of a rigid metal or wood or a rigid plastic material. The cover plate has a generally oval configuration essentially equivalent in size and shape to the upper face with a hole 42 therethrough overlying the aperture.

A threaded screw 48 extends through the hole of the cover plate into the aperture of the upper face to allow for the pivotal coupling of the cover plate to the upper face. The cover plate is adapted to be rotated between any of four positions. A first position 52 totally overlies the upper surface and closes all three recesses therein. A second position 54 ninety degrees from the closed position opens the first recess but partially closes the second and third recesses. A third position 56 one hundred eighty degrees from the closed position with its axis parallel to the axis of the upper face opens the third recess but partially closes the first and second recesses. Lastly, a fourth position 58 two hundred seventy degrees from the closed position opens the second recess but partially closes the first and third recesses.

A stack of paper sheets 60 is located within the third recess.

A quantity of smoking material 64, preferably tobacco, is in the second recess.

A rigid tube 68 is positioned within the first recess adapted to be removed by a user and inserted into the second opening for the forcing of smoking products to the interior thereof. Such tube is preferably designed to have the appearance of a cigarette.

A coil spring 72 is located within the first recess to assist in the removal of the tube.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. It is also intended that the present invention is intended to include the container by itself for receiving smoking components as well as the system including the container in combination with one or more of the smoking components.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A container system for smoking components and for the convenient storing and dispensing such components comprising, in combination:

a main body portion having a front face in a generally rectangular configuration, a rear face in a generally rectangular configuration and side faces in a generally semi-circular configuration with a closed lower generally oval lower face and an open generally oval upper face, the main body portion being fabricated of a rigid material;

a small circular first recess extending downwardly from the upper face toward the bottom face to a first distance for supporting a smoking tube and a large generally oval second recess extending downwardly from the upper face to a second distance less than the first distance for supporting a smoking substance and a third generally rectangular recess formed in the front face with short side walls and a short bottom wall for receiving smoking paper and a small threaded aperture extending downwardly from the upper face intermediate the first recess and closer to the rear face than to the front face;

a generally oval cover plate fabricated of a rigid material, the cover plate having a generally oval configuration essentially equivalent in size and shape to the upper face with a hole therethrough overlying the aperture;

a threaded screw extending through the hole of the cover plate into the aperture of the upper face to allow for the pivotal coupling of the cover plate to the upper face, the cover plate adapted to be rotated between any of four positions, a first position to totally overlie the upper surface and close all three recesses therein, a second position ninety degrees from the closed position to open the first recess but partially close the second and third recesses, a third position one hundred eighty degrees from the closed position with its axis parallel to the axis of the upper face to open the third recess but partially close the first and second recesses, and a fourth position two hundred seventy degrees from the closed position to open the second recess but partially close the first and third recesses;

a stack of paper sheets located within the third recess;

a quantity of smoking material in the second recess;

a rigid tube positioned within the first recess adapted to be removed by a user and inserted into the second opening for the forcing of smoking products to the interior thereof; and a coil spring within the first recess to assist in the removal of the tube.

2. A container system for smoking components comprising:

a main body portion having a front face, a rear face and side faces with a closed lower face and an open upper face;

a first recess extending downwardly from the upper face toward the bottom face, a second recess extending downwardly from the upper face and a small aperture extending downwardly from the upper face intermediate the first recess and second recess and closer to the rear face than to the front face;

a cover plate having a configuration essentially equivalent in size and shape to the upper face, with a hole therethrough overlying the aperture;

a fastener extending through the hole of the cover plate into the aperture of the upper face to allow for the pivotal coupling of the cover plate to the upper face, the cover plate adapted to be rotated between any of four positions.

3. The system as set forth in claim 2 wherein the positions include a first position to totally overlie the upper surface and close all openings therein, a second position ninety degrees from the closed position to open the first recess but partially close the second and third recesses, a third position one hundred eighty degrees from the closed position with its axis parallel to the axis of the upper face to open the third recess but partially close the first and second recesses, and a fourth position two hundred seventy degrees from the closed position to open the second recess but partially close the first and third recesses.

4. The system as set forth in claim 2 wherein a stack of papers is located within the third recess.

5. The system as set forth in claim 2 wherein a quantity of smoking material is located in the second recess.

6. The system as set forth in claim 2 and further comprising a rigid tube is positioned within the first recess adapted to be removed by a user and inserted into the second opening for the forcing of smoking products to the interior thereof.

7. The system as set forth in claim 6 and further comprises a coil spring within the first recess to assist in the removal of the tube.

* * * * *